US006082793A

United States Patent [19]

Gagnon

[11] Patent Number: 6,082,793

[45] Date of Patent: Jul. 4, 2000

[54] THREAD-ON COLLARED YOKE FOR POWER RISER PIPES

[76] Inventor: Emile H. Gagnon, 5 Cleveland Ave., Auburn, Me. 04210

[21] Appl. No.: 09/071,212

[22] Filed: May 1, 1998

[51] Int. Cl.[7] ..... B66C 1/34

[52] U.S. Cl. ..... 294/1.1; 294/82.1; 29/237; 29/255; 29/280

[58] Field of Search ..... 294/1.1, 90, 102.2, 294/86.12, 82.1, 82.11, 86.4; 29/237, 255, 264, 280

[56] References Cited

U.S. PATENT DOCUMENTS

| | | | |
|---|---|---|---|
| Re. 14,253 | 1/1917 | Wigle . | |
| 908,061 | 12/1908 | Andrew, Jr. | 294/102.2 |
| 1,344,922 | 6/1920 | Mildren | 166/88.4 |
| 1,436,621 | 11/1922 | Coultas . | |
| 1,500,459 | 7/1924 | Krell | 294/102.2 |
| 1,598,709 | 9/1926 | Butler | 294/102.2 |
| 1,654,009 | 12/1927 | Merten | 29/264 |
| 1,798,296 | 3/1931 | Yerkes . | |
| 2,149,938 | 3/1939 | Hickerman . | |
| 2,519,288 | 8/1950 | Roberson . | |
| 2,616,747 | 11/1952 | Ratigan | 294/81.5 |
| 3,675,278 | 7/1972 | Powell | 294/102.2 |
| 4,188,141 | 2/1980 | Stoot . | |
| 4,221,252 | 9/1980 | Bruce . | |
| 4,269,554 | 5/1981 | Jackson | 294/90 |
| 5,286,130 | 2/1994 | Mueller | 294/1.1 |
| 5,511,614 | 4/1996 | Jennings | 166/65.1 |

*Primary Examiner*—Dean J. Kramer
*Assistant Examiner*—Paul T. Chin
*Attorney, Agent, or Firm*—Stan Jones, Patents

[57] ABSTRACT

An attachable/detachable swivel hook and yoke for lifting a vertically oriented riser pipe section into place such that the lifted pipe section may be threadably joined to another upright riser section. The hook is swivel mounted to a yoke bracket and a threaded collar is adapted to threadably fit on the threads of a riser pipe to be lifted. The collar is held on the lifted riser pipe so that it may swivel on hook and be threaded to said upright riser pipe section.

20 Claims, 2 Drawing Sheets

THREAD-ON COLLARED YOKE FOR POWER RISER PIPES

BACKGROUND OF THE INVENTION.

1. Field of the Invention

The field of this invention relates to a threaded, removable collared winch yoke for installing or removing threaded electrical power riser pipes.

Such a yoke also relates to the field of utility electrical pipes and power supply services.

Further, the field of the invention relates to a removable, threaded hollow yoke centered for winch lifting of threadable riser pipes for above-ground feed of electrical power.

2. Description of Prior Art

In the utility field of supplying power services to consumers, a major problem relates to the assembly of the sectioned riser pipes that one sees next to utility poles. These riser pipes bring power from the pole base to the upper pole area. The nature of the riser pipe problems and prior art deficiencies are discussed in an enclosed incentive award description and account of the present invention in the *CMP Weekly Update* of Aug. 14, 1997. This Update article describes the invention, and actual units have been in use by Central Maine Power ("CMP")—the Awarding entity.

In the Power Company world such as CMP, underground utilities are increasing in numbers and whenever electrical power must emerge to the daylight from its underground run, a sectioned riser pipe is necessary. The riser pipe houses the service, or power, wire from the base of the pole to the top of the pole. Such riser pipe sections, when threaded together, are thus placed along side utility poles for local power distribution. These riser pipes are heavy, bulky and extremely hard to handle.

Since several threaded sections of heavy pipe are required for a full length rise, each individual section of riser pipe must be threaded to the next by threaded collars. Each new section must be suspended by a rope, chain or sling to be threaded to the previous upright section. The problem of long recognition was how to suspend such sections while threading them to the previously installed section.

A conventional prior art way of handling such riser sections involved slings or "off-center" rope lifts. Because the lifting point of the prior art was off-center, workers often are troubled trying to keep the pipe vertical for proper threading of one riser section to the next. Then, to make matters worse, as each section is being threaded, the rope or sling twists around the pipe, further complicating the job and risking damage both to the workers and to the threads.

Cross-threaded pipes and injuries have occurred. Thus, this prior art approach is both wasteful and dangerous, as well.

Installation of such risers, must also accommodate a pull cord that is inserted through the riser before lifting. Such a pull cord has a free upper end for the workers use and, in turn, is connected to an electrical power cable at the lower end. That pull cord, after the riser sections are joined together, is pulled through the assembled sections in order to retrieve and advance the electrical power lines which must also be lifted through the installed riser pipes. In the prior art this cord became entangled in the rope slings as the twisting was taking place.

Each riser installation involves several pipe sections which must be screw-threaded together, often by utility workers in a lift basket. Being both bulky and heavy, such risers pose a hazard to workers as they attempt to thread one riser section to another riser section by the use of threaded collars which span and join a pair of upright sections.

This invention markedly reduces the prior art hazards and facilitates connection of several riser sections. The pull cord entanglement problem has also been solved. The invention thus, for the first time, creates a solution to a problem that—though recognized—has long remained unsolved by the prior art.

A search of the prior art has revealed various patents, several of which are only of peripheral relevance and others that are greatly disadvantageous when compared to the unusual benefits of the subject invention.

The specific areas of search included:

Class 294 sub-classes 90, 91, 82.14, 82.15 and 82.16

Class 24 sub-classes 317 and 24.

The search turned up several patents of interest. The patents found for review are:

| | | |
|---|---|---|
| 4,221,252 | September 9, 1980 | Bruce |
| 2,519,288 | August 15, 1950 | Roberson |
| 4,188,141 | February 12, 1980 | Stoot |
| 14,253 | January 23, 1917 | Wigle |
| 1,436,621 | November 21, 1922 | Coultas |
| 1,798,296 | March 31, 1931 | Yerkes |
| 2,149,938 | March 19, 1936 | Hickman |

A brief discussion of this art follows: Taking the patents of the search in the order listed above:

U.S. Pat. No. 4,221,252 Sep. 9, 1980 Bruce

Bruce is simply a well known shackle apparatus. The primary emphasis of the Bruce patent concerns the manner of locking nut 5 to the shaft 6. Plastic locking pins and seating housings, as best shown in Bruce FIG. 2, for example, are employed. No threaded collar is suggested, much less such a threaded collar being incorporated into and made part and parcel of the entire lifting yoke.

U.S. Pat. No. 2,519,288 Aug. 15, 1950 Roberson

Roberson is an oil well hook that has little relevance unless studied upside down and then it still is not suggestive of the invention. Some pages are missing from the enclosed copy of Roberson, but from what can be understood, the Roberson hook seems to require a pressurized fluid cylinder which ultimately drives a locking dog 25 into one of a series of peripheral locking grooves 27 as shown in FIG. 3.

U.S. Pat. No. 4,188,141 Feb. 12, 1980 Stoot

The Stoot patent discloses a butt hook that is useful in logging operations and has a centrally located bore 16, FIG. 2, that houses a choker cable 11. Cable 11 is affixed with an end ferrule 17. The disclosure of this Stoot reference relates to different functions and achieves those different functions in a different way. It has only peripheral relevance to the invention.

U.S. Pat. No. 14,253 Jan. 23, 1917 Wigle

The Wigle patent is again involved with well casings. Wigle provides both a rotational and a swivel movement of hook 4. In the Wigle reference please note that sleeve 15, FIG. 2, has located therein a spring 10 which is formed around the shaft 17 and at the end of this centrally located shaft is positioned a double-sided ball bearing raceway formed by upper and lower disks 20 and 21. No threaded collar is involved nor is there any suggestion of the novel principles of this invention.

U.S. Pat. No. 2,149,938 Mar. 19, 1936 Hickman

Housing 1 of the Hickman reference has a partially open area whereas in Wigle it is completely blocked. Hickman housing 1 is rectangular in shape and is open at the bottom and at one side for receiving what are called sucker rods in well bores. A Hickman clevis 2 is held in place on the top of housing 1 by a nut/bolt 4 having a thrust bearing 5 to provide for rotational movement. Apparently, the sucker rods such as 14 (shown in dashed lines) are rectangular shaped at the upper end and those ends are adapted to fit within opening 7 in housing 1. Such sucker rods are solid and do not compare favorably with open threaded hollow collars or riser pipes.

U.S. Pat. No. 1,436,621 Nov. 21, 1922 Coultas

U.S. Pat. No. 1,798,296 Mar. 31, 1931 Yerkes

These two references do not seem to add anything to the above-noted art, but are listed for sake of thoroughness.

In summary, none of the well casing hook lifts (including Wigle or Hickman discussed above) would serve or suggest the functions of the present invention, since none of them have an opening therethrough such as a hollow threaded collar, which opening receives the pull cord or electrical power cables that must be threaded through the riser sections.

Moreover, none of the references teach or suggest a set screw fastener to hold a threaded collar affixed to a riser pipe for hoisting and vertical alignment when threading one riser section to another upright riser section. Being centered and held in a vertically plumb position by the invention, threading of one riser section to another is easily accomplished whereas in the "off-center" prior art it was a difficult and dangerous undertaking.

SUMMARY OF THE INVENTION

Disclosed and claimed herein is a hollow, threaded collared swivel yoke for lifting and threading riser pipe sections. A threaded collar is incorporated into and made part and parcel of the entire lifting yoke. When used for lifting, that collar is seized to the pipe section by a fastening device, such as a set screw. Then, when the section has been erected and threaded to the previous section that set screw is backed out and the yoke is easily removed for a later lift.

Several sized pipes are encountered in the field, and thus the riser yoke is easily assembled and dis-assembled in order to accommodate these differing sizes. Accordingly, each threaded stub end of the lifting hook is drilled crosswise where it mates with a castle nut that accept quick pull carter-like pins for secure assembly yet easy disassembly as well. Several sized collars with opposed opening pairs for receiving the yoke brackets are provided. The most popular sized riser pipes are four inch diameter, five and six inch diameters. A yoke bracket sized for the five inch riser can also be fitted and bolted within the six inch pipe collar and may be located on the outside of the four inch pipe for convenience in the field.

A yoked swivel includes a shielded hook and a guide ring fastened into or otherwise welded to the hook, so that the workmen can guide the yoke unit when a coupled pipe section is being lifted by a crane. The bottom stub of the hook has a threaded extension that passes through an opening in the top of the yoke and through a washer serving as an upper bearing surface for a thrust bearing which is seated below the washer. This thrust bearing is located under the yoke where it is held in place by a pinned castle nut having an upper flat surface serving as a lower seat surface for the thrust bearing.

A swivel yoke is side bolted by a pair of stub bolts located at opposed sides of a hollow circular lift collar, which side bolts are brought out from the inside to the outside of the collar to hold the yoke to the collar. These opposed bolt openings are located through the collar at points slightly above the center of the collar such that it and the riser always tend naturally to fall below and stay on a vertically plumb line through the lifting yoke.

In use, the lift collar is first threaded on the top of a riser pipe section which is to be lifted, and is removably affixed to that section by a fastener, such as a set screw. The screw is tightened in place so that both the yoked collar and the riser pipe section may together be hoisted in place.

The swivelled hook is centered on the center of the collar and thus these centers also fall along a longitudinal center of a vertically held pipe section. The invention thus perfectly aligns an upright lifted riser pipe for a proper threading of the lift section to the previous upright section. The swivel hook allows a workman in a lift bucket to turn the lifted pipe as needed for threading to the previous section.

A smooth collar guard made of plastic-like material threads into the top of the collar and encircles the upper threaded section of the collar. Such a guard may either be permanent or removable and it serves to protect the pull cord and power line from possible damage by burrs that may be present on the inside of the threaded collar.

A pull cord has a lower end connected to an electrical power line which may be running underground to the pole area of interest. A craftsman first passes a loose upper end of this pull cord through the riser pipe while it is on the ground and prior to the section being raised. This cord must also pass through the hollow collar so that it emerges from the top of the collar and provides a way to later allow the craftsmen to "fish" the power line through the raised riser pipe sections.

An enlarged pull opening is provided on the pull pin that is seated in the castle nut holding the lower raceway in place. A worker simply ties the pull cord on this pull ring so that it is available to the linemen in the lift bucket. Since the pull cord is also centered and is tied to a relatively fixed point—the base of the hook—the pipe, collar and yoke can turn around the cord without fear that the cord will become entangled in the process as was the case in the prior art.

OBJECTS OF THE INVENTION

It is an object of the invention to provide a thread-on, collared yoke for lifting and installing power riser pipes.

It is an object of the invention to provide a lift collar equipped with easily attached/detached connecting yoke.

It is another object of the lift collar invention to provide a threaded attachment collar which is seized to a riser pipe section and forms part of the lifting yoke itself.

It is yet another object of the invention to provide a yoke that is easily adapted for several sizes of riser pipes.

It is a further object of the invention to provide a swivel hook that is attached to a threaded collar and this collar and hook are centered and vertically plumb above and through the center of a lifted riser pipe.

It is yet one further object of the invention to provide a shielded hook centered on a swivel located above a threaded collar.

It is still one further object of the invention that it contains a pull ring on the hook for bucket or ground guidance involved in the lifting of a riser pipe.

It is still one further object of the invention to protect a pull cord from entanglement while making the loose end of such cord available to a worker in a lift bucket.

It is yet one further object of the invention to tie the pull cord on a fixed center location of the swivel yoke so that the pipe, collar and yoke can turn around the cord without fear that the cord will become entangled.

It is another additional object of the invention that a thrust bearing for a swivel hook is centered below the hook but above the threaded collar.

It is still one further object of the invention to place a guard surface on the inner threaded side of the collar in order to protect a pull cord or power lines which are pulled through the riser pipe.

It is an object of the invention to provide a yoke that is removably attached to the collar by stub bolts brought out through openings located through the sides of the collar.

It is an object of the invention to provide a conveniently located cord tie on a quick pull pin through a castle nut holding a swivel thrust bearing in place.

It is a final object of the invention to provide an easily removed yoke from the collar by carter pinned nuts located on the outside of the collar.

DETAILED DESCRIPTION OF THE DRAWINGS

Figure 1:
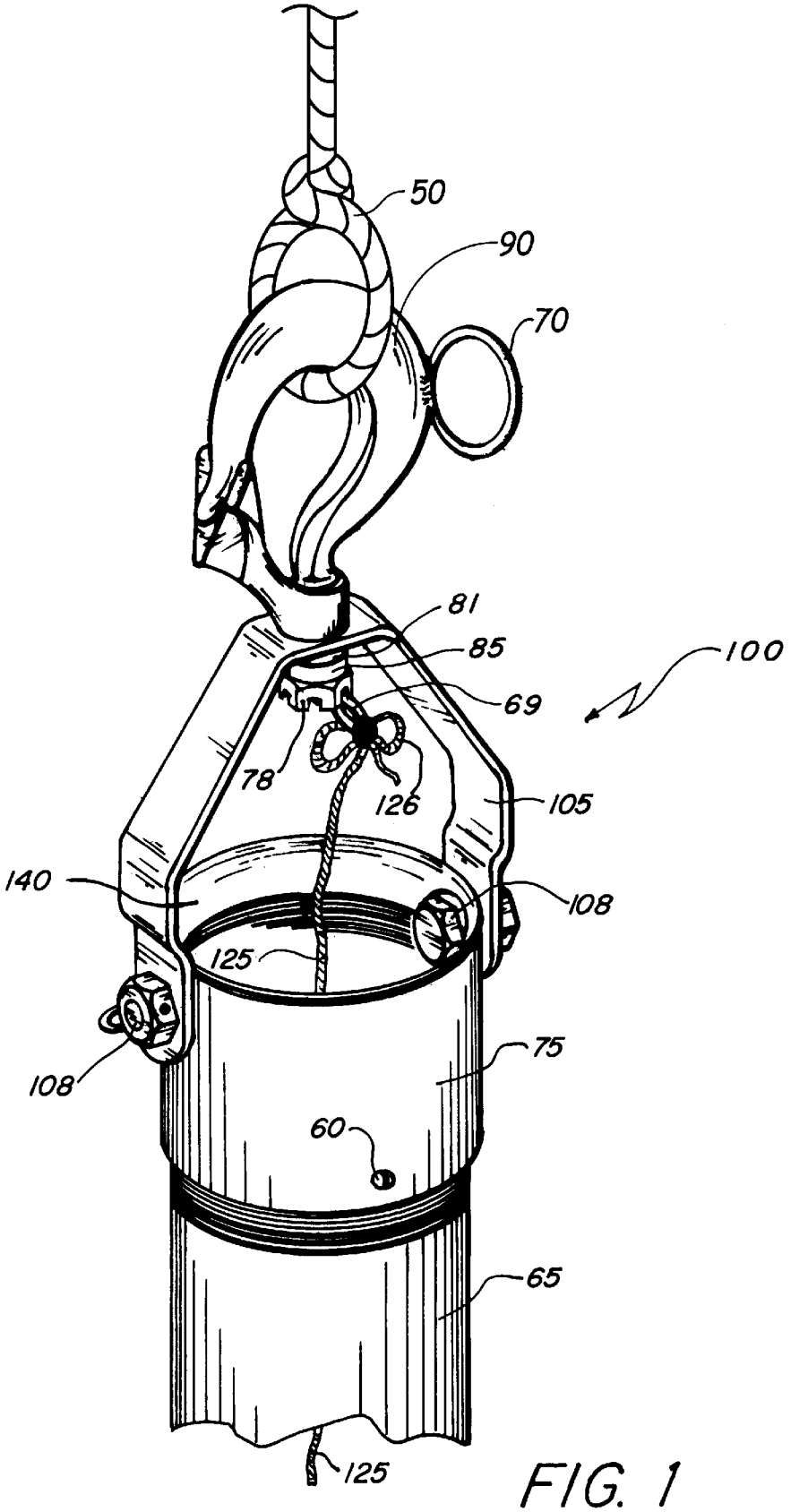
FIG. 1 shows a perspective view of the invention in one preferred embodiment.

Turning in detail to the drawings, FIG. 1 presents a commercialized form of my thread-on collared yoke invention. The yoke 100 may preferably be made of iron, steel or other durable and strong material. FIG. 1 shows the yoke invention 100 in its current preferred embodiment with like numbers being used in FIGS. 1 and 2.

The swivel yoke invention 100 includes a shielded hook 90 that is normally lifted by an eyed winch rope 50 in any standard manner. Welded or otherwise fastened to hook 90 is a guide ring 70 which receives a rope in order to allow workmen to guide the yoke unit 100 when a coupled pipe section is being lifted by a crane winch (not shown). Note that yoke 100 is connected by collar 75 to a riser pipe 65 in this FIG. 1.

Riser pipes to be installed are normally lying on a truck bed or the ground, and thus it is an easy matter to place the yoke 100 on such a pipe. Preferably, the collar 75 is first screwed on without the bracket being attached. Since the one and same collar type that is used to permanently mate two standing pipes is being threaded onto the pipe, this collar is easily put in place and then the yoke may further be assembled for a lift operation.

During installation collar 75 must not turn on the lifted pipe. Accordingly, collar 75 is seized or firmly held to pipe 65 by a fastener, such as set screw 60 which has been threaded into secure contact with the riser pipe 65. A workman simply turns screw 60 into mating threads—placed in a suitable opening 61, FIG. 2. That turning seizes collar 75 to pipe 65.

An inverted V-shaped yoke bracket 105 has a pair of oversized openings 112 (FIG. 2) located at each end of the downward depending bracket ends. Collar 75 likewise includes a pair of opposed slightly oversized openings 110, which openings are located in a collar space that remains above the first threads on the coupled riser pipe. An opposed pair of bolts 108 are each passed through these slightly oversized openings 110, 112 in the bracket and upper section of collar 75 in order to loosely bolt the collar 75 to the yoke bracket 105.

Figure 2:
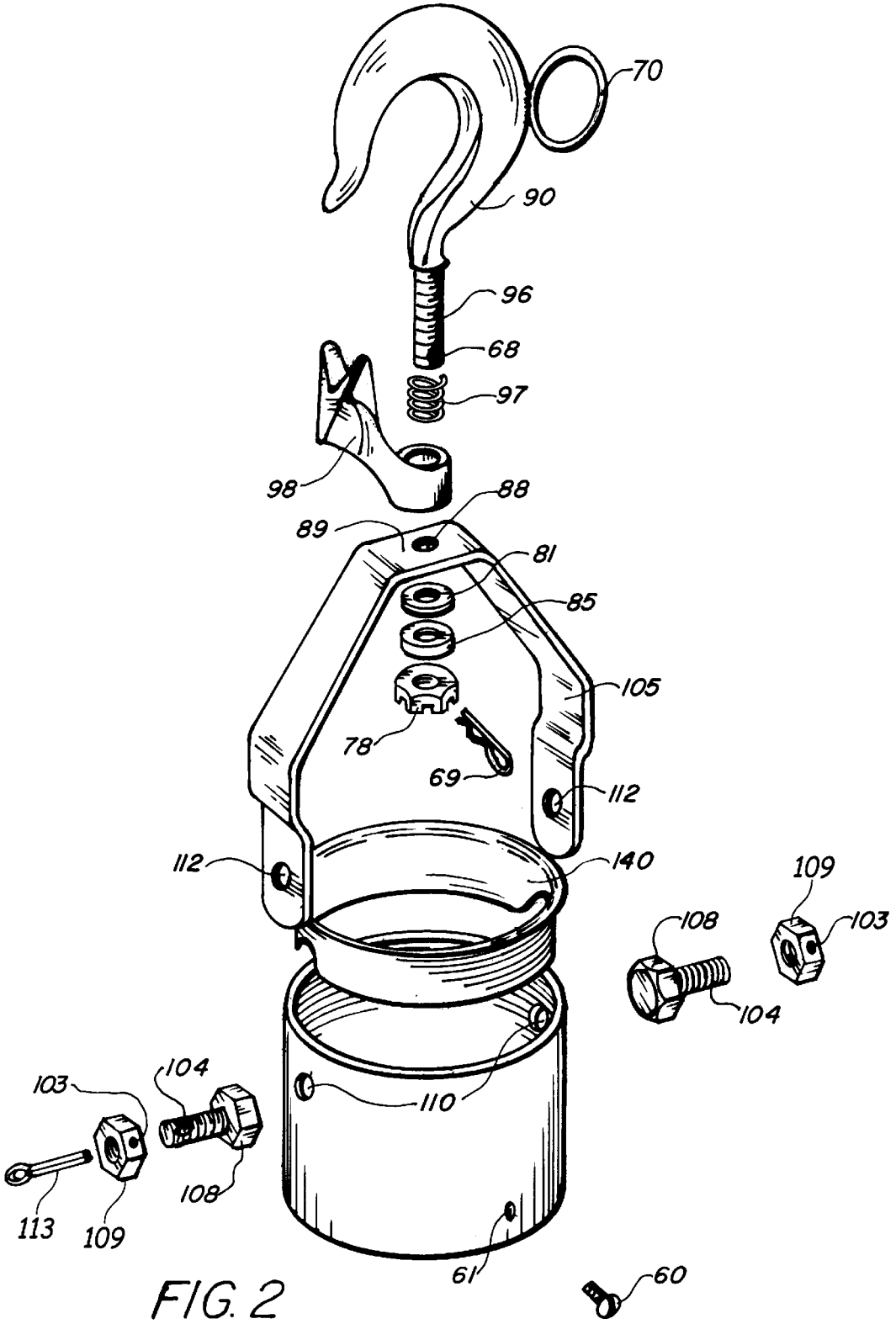
FIG. 2 shows an exploded view of the invention.

Nuts 109 include orthogonally drilled pin holes 103 and bolts 108 likewise includes such orthogonally drilled pin holes 104 which align with holes 103 in nuts 109 to receive carter pins 113 (FIG. 2). Such as assemblage loosely secure the yoke bracket 105 to collar 75 in the assembled condition shown in FIG. 1. A loose connection provided by the oversized openings 110 and 112 allows a side to side rocking motion to take place on a lifted riser pipe when an installation is underway. This motion provides the play necessary for centering one riser pipe on the next.

Hook 90 is provided with a completely free 360 degree swivel motion by a thrust bearing 85 mounted below the flat upper surface of inverted V bracket 105. As perhaps best shown in FIG. 2, the lower part of hook 90 includes a threaded stub end 96 which is seated in spring 97 and then through an opening in shield plate 98. Stub 96 then passes through opening 88, which opening is located through the flat plate surface 89 of bracket 105.

On the lower location of the stub end 96 are respectively placed a washer 81, a thrust bearing 85 and a castle nut 78. Castle nut 78 includes a notched lower surface in order to receive a quick connect pin 69 that is passed through a hole 68, FIG. 2, located near the end of stub 96. The assembled swivel for hook 90 is shown in FIG. 1. While hook 90 is fixed relative to the winch rope 50, the yoke/collar combination can freely turn on thrust bearing 85. Thrust bearing 85 has been selected to handle the weight of the pipe sections encountered in the field.

The enlarged opening for the quick connect pin 69 serves a dual function. Beside receiving a worker's finger it allows a pull cord 125 to be tied to pin 69 after cord 125 has been run through the length of an non-installed riser pipe 65. Such a pull cord 125 is connected at the other end to an electrical power line which may be running underground to the pole area of interest.

A craftsman first passes this pull cord 125 through the riser pipe 65 while it is on the ground and prior to the section 65 being raised. This cord 125, of course, must also pass through the hollow collar 75 so that it emerges from the top of the collar 75 and provides a tied knot 126 which can later be untied, and thus provide a way for the craftsmen to "fish" the power line through the raised riser pipe sections.

A smooth collar guard 140 which may be made of plastic-like material is seated into or loosely threads into the top of the collar 75 and encircles the upper threaded section of collar 75. Such a guard 140 may either be permanent or removable and it serves to protect the pull cord 125 and the power line from possible damage by burrs that may be present on the inside of the threaded collar 75.

As has been shown, a new and novel swivel hook has been described which includes a threaded collar for threaded connection to a pipe to be lifted. That threaded collar is provided with openings to receive a yoke bracket and a swivel hook. Nothing in the art suggests such a threaded collar being incorporated into and made part and parcel of the entire lifting yoke 100.

While my invention has been described with reference to particular preferred embodiments, it is my intention to cover all modifications and equivalents within the scope of the following claims. It is therefore requested that the following claims, which define my invention, be given a liberal interpretation which is within the spirit and scope of securing adequate protection commensurate with my novel contribution to this art.

What is claimed is:

1. An attachable/detachable swivel hook and yoke bracket for lifting a vertically oriented utility riser pipe section having a longitudinal conduit bore therein into place where the lifted pipe section may be threadably joined to another upright section by mating threads in order to allow electrical power cables to run through the conduit formed by the mated risers, said hook comprising:

hook attachment means swivel mounted to a yoke bracket for receiving a winch lift;

a hollow threaded collar adapted to threadably fit on the threads of a riser pipe to be lifted, said threaded collar detachably incorporated into and made part of said lifting yoke yet being removably fastened thereto;

manually operable means lying in planes transverse to the longitudinal bore for removably securing said collar to said yoke bracket and fixably yet removably securing said threaded-on collar to a riser section and allowing a lifted riser section to rotate in a vertically plumb position and thus mate itself with another riser; and means associated with said collared lifting yoke for allowing a utility worker to fish power lines through such threadably mated risers and said hollow collar.

2. A swivel hook in accordance with claim 1 wherein said hook remains in a relatively fixed position while said riser is rotated, and said hook further comprising:

an opening in said yoke bracket for receiving a downward depending stub section of said hook; and a thrust bearing around said stub section and mounted for rotation under said bracket in order to provide for collar and riser rotation under said hook.

3. A swivel hook in accordance with claim 1 wherein said manually operable means further comprises:

means for fastening a conduit fish line available to a worker in a lift bucket such that said lifted riser pipe may safely swivel on said hook while such worker rotates the riser section being threaded to said upright riser pipe section.

4. A hollow, collared swivel hook for vertically lifting a normally horizontally oriented utility pipe section into place where the lifted pipe section may be vertically oriented by the lift and threadably joined to another riser by mating threads of another riser pipe, said hook comprising:

a threaded collar incorporated into and made part of a lifting yoke by being bolted to the hook;

a thrust bearing for said lifting yoke which allows said yoke to rotate in a vertically plumb position and thus threadably mate itself to said other riser; and thread means for fixably yet removably securing said collar to said lifted riser pipe to be threaded to said other riser.

5. A swivel hook in accordance with claim 4 and further comprising:

means for causing said collar to be seized to the pipe section to be lifted by a fastening device such as a manual set screw.

6. A swivel hook in accordance with claim 4, when the riser section has been erected and threaded to the previous riser, said hook further comprising:

said set screw may be backed out from its seized location and the yoke easily removed from the erected and mated risers for use in a later lift.

7. A swivel hook in accordance with claim 4 wherein several sized riser pipes are encountered in the field, and said swivel hook further comprises:

several different sized threaded collars adapted to be threaded on said different sized riser pipes; and means providing for easy assembling and dis-assembling of said yoke from said collar in order to accommodate these differing riser pipe sizes.

8. A swivel hook in accordance with claim 7 wherein said assembly/dis-assembly means includes:

threaded bolt ends located in holes drilled crosswise through the collar(s) where it mates with a holding nut that accepts carter pins for secure assembly yet easy disassembly as well.

9. A swivel hook in accordance with claim 7 wherein said assembly/dis-assembly means includes:

a shielded hook and a guide ring fastened into or otherwise welded to the hook so that the workmen can guide the yoke unit when a coupled pipe section is being lifted into place.

10. A swivel hook in accordance with claim 4 wherein said hook includes:

a bottom stub extension of said hook, which extension passes through an opening in the top of the yoke;

a washer serving as an upper raceway surface for said thrust bearing which is seated below the washer.

11. A swivel hook in accordance with claim 10 wherein said hook includes:

a thrust bearing located under the washer, with the washer serving as an upper bearing seat for said thrust bearing; and said thrust bearing held in place by a pinned castle nut having an upper flat nut surface which serves as a lower bearing seat for said thrust bearing.

12. A swivel hook in accordance with claim 4 wherein said hook includes:

a swivel yoke;

means side bolting said collar to said yoke by a pair of stub bolts located at opposed sides of said collar, which side bolts are brought out from the inside to the outside of said collar in order to hold the yoke to the collar for easy dis-assembly and removal of said hook by a utility worker in an elevated bucket.

13. A swivel hook in accordance with claim 4 wherein said hook includes:

opposed bolt means pass through a pair of opposed slightly oversized openings which are located through said collar at points somewhat above the center of the collar and leaving sufficient collar threads below said bolts for a secure seize of the riser pipe section to be lifted; and such openings being positioned such that both the collar and the riser naturally tend to fall below and stay on a vertically plumb line with the upright riser pipe section to be joined with the lifted pipe section.

14. A swivel hook in accordance with claim 4 wherein a pull cord is connected to a power line to be pulled through the erected riser pipe, said hook further comprises:

a smooth collar guard located on the upper interior of said collar and encircling the upper threaded section of the collar for protecting a pull cord and/or a power line from possible damage by burrs that may be present on the inside of the threaded collar.

15. A swivel hook in accordance with claim 14 wherein said pull cord is connected to a power line to be pulled through the erected riser pipe, and said hook further comprises:

means allowing a worker to tie the pull cord on the hook so that the pipe may rotate around the cord and the cord is available to a linemen in a lift bucket.

16. A method of lifting and threading an upright riser pipe section having threads at both ends to another such section, said method comprising:

forming a threaded collar as a lower lifting portion of a lifting yoke;

threading said collar onto a riser pipe section on the ground and intended to be to be lifted and mated to another fixed riser pipe when in a vertical position;

fixably yet removably securing said collar to said lifted riser section in order to allow said lifted riser section to rotate in a vertically plumb position;

lifting said riser section into a vertically upright position by said thread-on collar;

assuring rotation manually of said yoke, said fixably secured collar and the lifted riser in said vertically upright position;

manually threading said lifted riser pipe into said upright riser pipe;

removing the lifting yoke from a workman bucket elevated in the air above the ground; and manually installing power lines through a continuous conduit formed in the mated riser pipes.

17. A method of lifting and threading an upright riser pipe section to another section in accordance with claim 16, said method further comprising the steps of:

fixably threading said collar to said lifted riser pipe such that the collar does not turn as the vertically oriented upright riser pipe is being manually mated to another pipe section.

18. A method of lifting and threading an upright riser pipe section to another section in accordance with claim 17, said method further comprising the steps of:

removably affixing the collar which is threaded on the top of a grounded riser pipe section which is to be lifted by a fastener such as a set screw;

tightening the set screw in place so that both the collar and the riser pipe section may together be hoisted in place; and fastening a power conduit fish line available to a worker in a lift bucket such that said lifted riser pipe may safely swivel below said hook while such worker rotates the riser section being threaded to said upright riser pipe section.

19. A method of lifting and threading an upright riser pipe section to another section in accordance with claim 17, said method further comprising the steps of:

including a guide pull ring on said yoke in order to allow workers to steer the lifting pipe section from the ground or from a raised lift bucket.

20. A method of lifting and threading an upright riser pipe section to another section in accordance with claim 16, said method further comprising the steps of:

centering the swivelled hook on the center of the collar and thus the pipe section such that both are aligned for a proper and safe threading of the lifted pipe section to the other pipe section.

* * * * *